US006520721B2

(12) United States Patent
Legleux

(10) Patent No.: US 6,520,721 B2
(45) Date of Patent: Feb. 18, 2003

(54) APPARATUS FOR GUIDING THE LEGS OF A LIFT BOAT

(76) Inventor: Michael J. Legleux, 218 Avant Garde Cir., Kenner, LA (US) 70065

( * ) Notice: Subject to any disclaimer, the term of this patent is extended or adjusted under 35 U.S.C. 154(b) by 0 days.

(21) Appl. No.: 10/230,817

(22) Filed: Aug. 29, 2002

(65) Prior Publication Data

US 2002/0197113 A1 Dec. 26, 2002

Related U.S. Application Data

(62) Division of application No. 09/785,707, filed on Feb. 16, 2001, now Pat. No. 6,461,081.

(51) Int. Cl.[7] ..... B63B 35/44; E02B 17/08
(52) U.S. Cl. ..... 405/199; 114/265
(58) Field of Search ..... 405/196, 198, 405/199, 203, 204; 114/264, 265

(56) References Cited

U.S. PATENT DOCUMENTS 85,598 A * 1/1869 Lewis ..... 405/198
3,995,439 A * 12/1976 Hahlbrock ..... 405/161
4,015,434 A * 4/1977 Tarrant ..... 405/198
4,427,319 A * 1/1984 Mayr ..... 405/196
4,456,404 A * 6/1984 Evans ..... 405/196
4,466,488 A * 8/1984 Nayler et al. ..... 166/355
4,505,614 A * 3/1985 Anschutz ..... 405/195.1
4,657,437 A * 4/1987 Breeden ..... 405/198
4,813,814 A * 3/1989 Shibuta et al. ..... 405/198
5,092,712 A * 3/1992 Goldman et al. ..... 405/196
5,611,645 A * 3/1997 Breeden ..... 405/196
6,076,996 A * 6/2000 Choate et al. ..... 405/198
6,293,734 B1 * 9/2001 Thomas et al. ..... 405/209

* cited by examiner

*Primary Examiner*—Thomas B. Will
*Assistant Examiner*—Tara L. Mayo

(57) ABSTRACT

An apparatus for guiding the legs of a lift boat. Continuous track assemblies are used to guide the legs. The assemblies may be placed at any location or in any number vertically along the leg to adequately center the leg. The track assemblies are comprised of link plates 88, link pins, and track pads traveling around idlers. The track assemblies are mounted on rail structures.

1 Claim, 4 Drawing Sheets

APPARATUS FOR GUIDING THE LEGS OF A LIFT BOAT

This application is a division of application Ser. No. 09/785,707 filed on Feb. 16, 2001, now U.S. Pat. No. 6,461,081.

BACKGROUND OF THE INVENTION

1. Field of the Invention

The invention is generally related to a lift boat or jack-up rig and more particularly to the mechanism for raising and lowering the legs of a lift boat or jack-up rig.

2. General Background

In offshore work related to the search for and production of oil and gas, a variety of vessel types are used. One type is a lift boat. A lift boat is a vessel that can elevate itself out of the water so as to provide a stable platform at the appropriate elevation to perform a number of marine construction tasks. Lift boats are equipped with retractable legs that each has a footing at the bottom. The footings contact the bottom and are of sufficient size to support the vessel on the seabed. The number of legs can vary from three to as many as six. One or more cranes are fixed to the deck of the vessel and are used to lift equipment onto or off of oil drilling or production platforms. A larger version of the lift boat called a jack-up rig typically is outfitted with drilling equipment. From this point on all mention of lift boats shall also be understood as including jack-up rigs.

At least one gear rack is typically incorporated into each leg of a lift boat. The legs of a lift boat are either constructed as a lattice type or as a tubular type. One or more pinion assemblies operate along each gear rack. A pinion assembly typically consists of a pinion, gear box, braking mechanism and either an electric or hydraulic motor. The pinion assemblies are either rigidly fixed to the vessel or can be of the floating type. As the pinions of the lift boat rotate, the lift boat is either raised out of the water or lowered toward the surface of the water depending upon the direction of pinion rotation.

The legs can be somewhat self-centering if multiple gear racks are used on the legs and if the gear racks are arranged properly. Even if the racks are ideally numbered and positioned some side loading of the legs will occur due to sea, wind, and vessel loading conditions. The current generation of lift boats employs a linear metal bearing guide to restrict leg movement. This guide system consists of metal bearing strips attached to the vessel or to the jacking apparatus. The guides may ride along the gear rack, the leg cords, or attachments to either the leg or gear rack. Smaller lift boats have leg towers constructed from tubular members and have tubular legs with outside diameters slightly smaller than the inside diameters of the leg towers. The leg tower is the sole guide. The shortcomings of these types of guide apparatus are that friction between the leg and guides increases the jacking force required to operate the lift boat and much of the lubricant used on the guides is dropped into the sea.

SUMMARY OF THE INVENTION

The present invention addresses the above needs in a straightforward manner. What is provided is an apparatus for efficiently guiding the legs of a lift boat. Roller assemblies are used to guide the legs. The rollers may be placed at any location or in any number either vertically or around the leg to adequately center the leg. The roller can either have a metal surface that rolls along the leg or be coated with a resilient material. The base of the roller can either be rigidly mounted to the vessel or incorporate resilient material between the roller and the vessel. A means of adjusting the clearance between the leg and roller may be incorporated in the roller assembly.

BRIEF DESCRIPTION OF THE DRAWINGS

For a further understanding of the nature and objects of the present invention reference should be made to the following description, taken in conjunction with the accompanying drawings in which like parts are given like reference numerals, and wherein.

DETAILED DESCRIPTION OF THE PREFERRED EMBODIMENT

Figure 2:
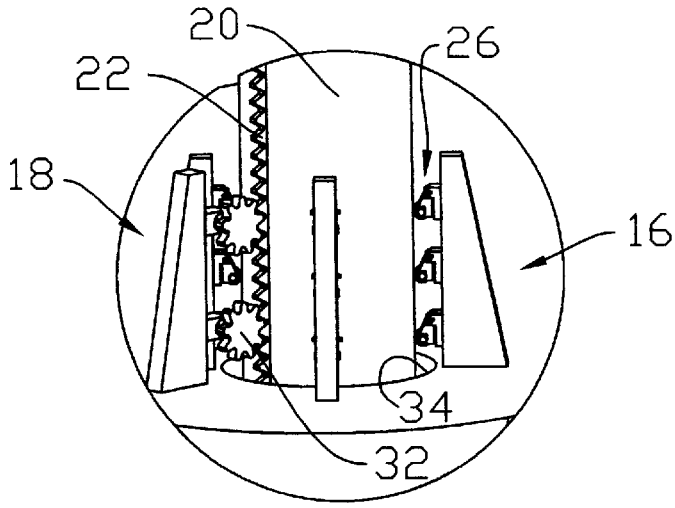
FIG. 2 is a detail view of a jacking and guide apparatus.
Figure 1:
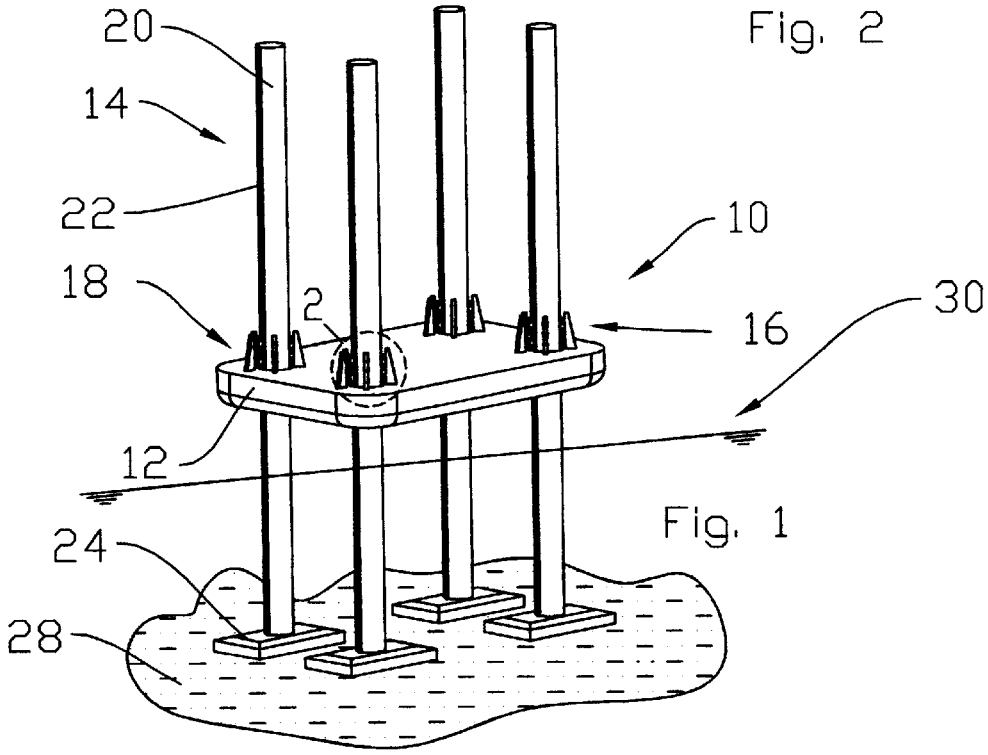
FIG. 1 is an isometric view of a lift boat.

Referring to FIG. 1, it is seen that a typical lift boat is generally indicated by the numeral 10. For ease of illustration the lift boat's deckhouse, cranes and all deck equipment have been omitted. The lift boat is generally comprised of a hull 12 and a plurality of legs 14. The hull 12 is a buoyant hull that has sufficient buoyancy to support the hull, legs, and any equipment placed on the hull. As seen in FIG. 1, the lift boat is elevated above the water's surface 30. As seen in FIG. 2 each leg 14 is received through a leg well 34 provided near each corner of the hull 12. The outer diameter of each leg 14 is less than the diameter of the leg well 34 so as to be movable through the hull 12. Although only a tubular column 20 is shown, it should be understood that the legs 14 may be formed from either a tubular or lattice column. Each leg 14 is provided with a rack 22 and a footing 24. The legs 14 may have singular or multiple racks 22. The leg 14 is raised and lowered through the hull 12 by a pinion tower 18. Each rack 22 may have singular or multiple pinions 32. Multiple pinion towers 18 may be separately attached to the hull 12 or may be integrated into a unit attached to the hull 12. The footings 24 are of sufficient size to provide resistance to the seabed 28 to allow the pinion tower 18 to elevate the hull 12 above the surface of the water.

Figure 4:
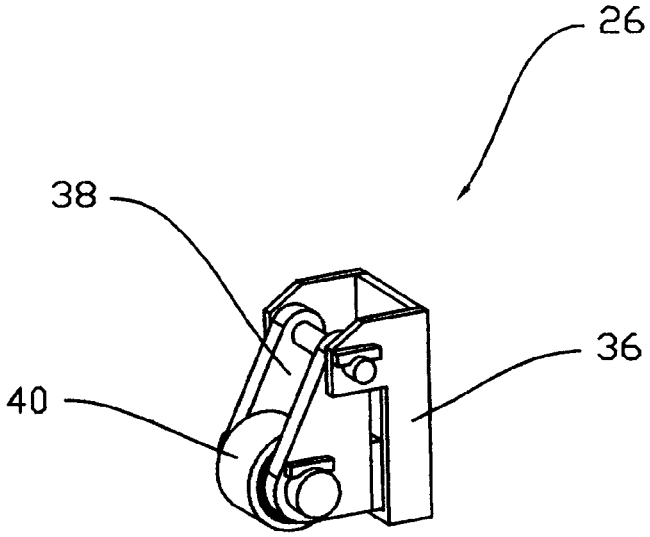
FIG. 4 is an exploded view of the guide roller assembly.
Figure 3:
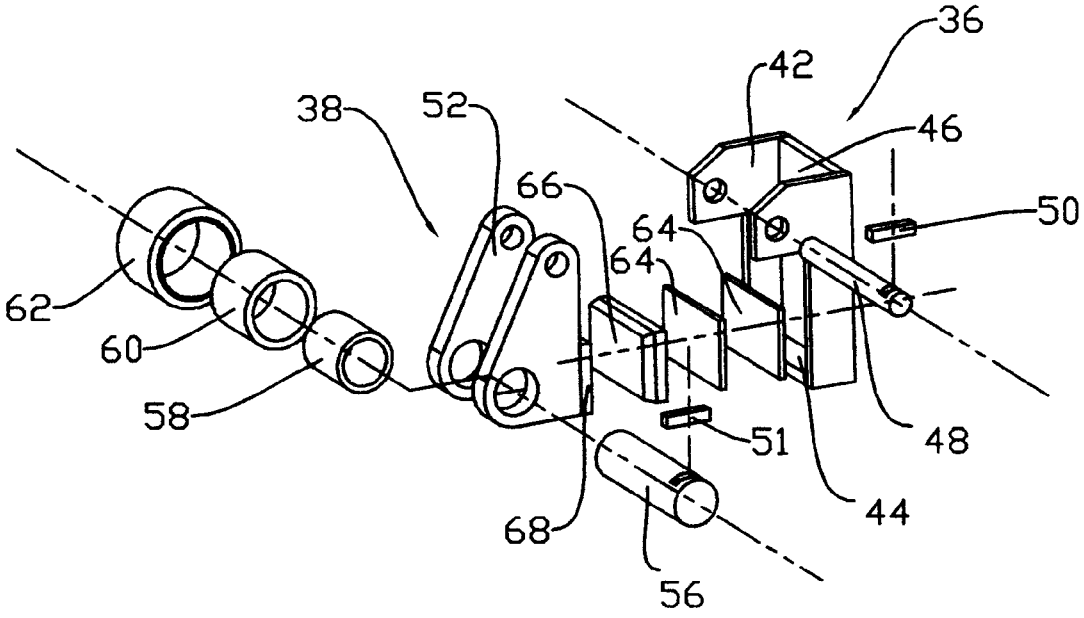
FIG. 3 is an isometric view of the guide roller assembly.

Referring to FIGS. 2–4, it is seen that the invention is generally indicated by the numeral 26. Guide roller apparatus 26 is generally comprised of a support box 36, a pivot arm 38 and a roller 40.

The support box 36 is formed from two or more support box side plates 42 that are attached to a support box back plate 46 and a support box bottom plate 44. A support box pin 48 connects the pivot arm 38 to the support box 36. A keeper 50 prevents the support box pin 48 from sliding out of the support box 36. The keeper 50 is attached to the support box 36 by any suitable means such as by welding, mechanical fastener, or by the use of an adhesive.

The pivot arm 38 is of suitable shape to transfer forces from the leg 14 to the hull 12. The pivot arm 38 is formed from two or more pivot arm side plates 52 that are attached to a pivot arm back plate 68. A pivot arm pin 56 connects the roller 40 to the pivot arm side plate 52. A keeper 51 prevents the pivot arm pin 56 from sliding out of the pivot arm side plates 52.

The roller 40 is of suitable shape to transfer forces from the leg 14 to the hull 12. A bushing 58, an inner core 60, and an outer core 62 are assembled together to make up the roller 40. The bushing 58 is of suitable shape and material to allow it, the inner core 60, and the outer core 62 to rotate around pin 56. The bushing 58 may be constructed of non-lubricated or lubricated material. The bushing 58 is attached to the inner core 60 by interference fit, bonded, or keyed to prevent relative movement. The inner core is constructed of suitable rigid material such as steel and attached to the outer core 62 by interference fit or bonded to prevent relative movement. The outer core 62 is formed from a suitable resilient material such as neoprene.

One or more spacer plates 64 are of suitable shape and material to transfer forces from the leg 14 to the hull 12. Resilient plate 66 is of suitable shape and material to transfer forces form the leg 14 to the hull 12. Spacer plates 64 may be of varying thickness and number to adjust the nominal distance between the roller 40 and the leg 14 from a clearance to a compressed pre-load. In a pre-load condition the resilient outer roller 62 and the resilient plate 66 are deformed so that during normal operating conditions there is no clearance between roller 40 and leg 14.

The guide roller apparatus 26 may be securely attached to either the hull 12, pinion tower 18 or, as seen in FIG. 2, to a guide roller tower 16. The guide roller apparatus 26 may be the sole means of guiding the leg 14 or may be used in conjunction with bearing strips or any other suitable guide apparatus. The guide roller apparatus 26 may be set to a desired clearance or pre-load to the leg column 20, rack 22, or any attachment to either. The roller apparatus 26 is of sufficient size, number and location to adequately restrict the leg 14 to movement with the hull 12. The guide roller tower 16 may be attached directly to the hull 12 or incorporated into the hull 12, pinion tower 18 or other parts of the lift boat 10.

In operation, as the legs 14 are moved up or down through the hull 12, the guide roller apparatus 26 on each leg 14 confines each leg 14 to a near perpendicular orientation relative to the deck of the hull 12. The advantage this provides is that it prevents any out of alignment movement, which decreases the efficiency of the driving system and increases the possibility of damage.

Figure 5:
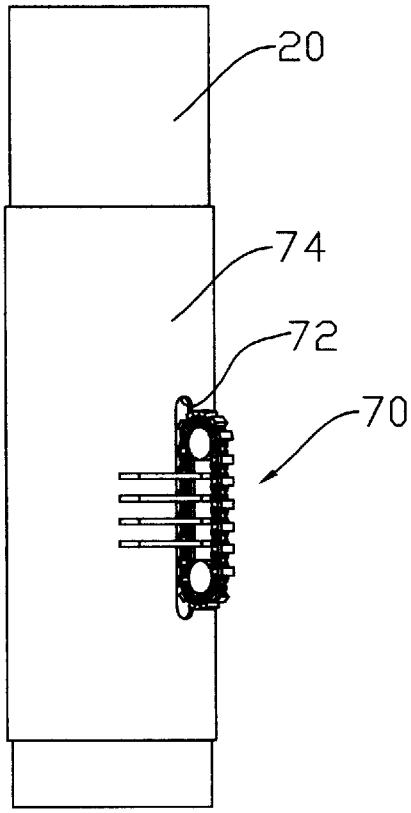
FIG. 5 illustrates an alternate embodiment of the invention.
Figure 6:
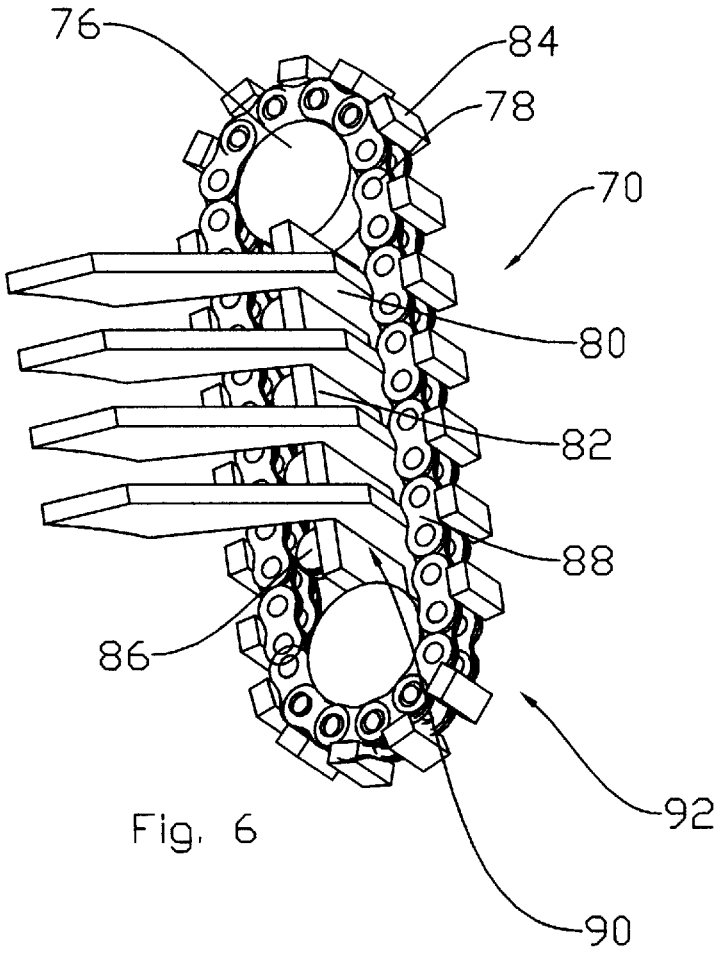
FIG. 6 is a detail view of the alternate embodiment of FIG. 5.

An alternate embodiment of the invention is generally indicated by numeral 70 in FIGS. 5 and 6. Track guide apparatus 70 is generally comprised of track 92, rail structure 90, idlers 76 and rollers 86. For ease of illustration, the hull and pinion tower are not shown.

A leg tower 74 is attached to the lift boat and is sized to allow movement of the leg 14 therethrough. The leg tower 74 is provided with an elongated opening 72. Track guide apparatus 70 is attached to the leg tower 74 and contacts the leg 20 through the elongated opening 72 in the leg tower.

As best seen in FIG. 6, the track 92 is comprised of link plates 88, link pins 78, and track pads 84 traveling around idlers 76. The force exerted upon the track 92 by the leg 20 is transferred to the rail structure 90 via the rollers 86. The rollers may be of a similar design as shown in FIG. 4 or of any other design suitable to transfer the force. The rail structure generally indicated by numeral 90 is comprised of a rail 82 and rail flanges 80. The rail flanges 80 are attached to the leg tower 74.

Figure 7:
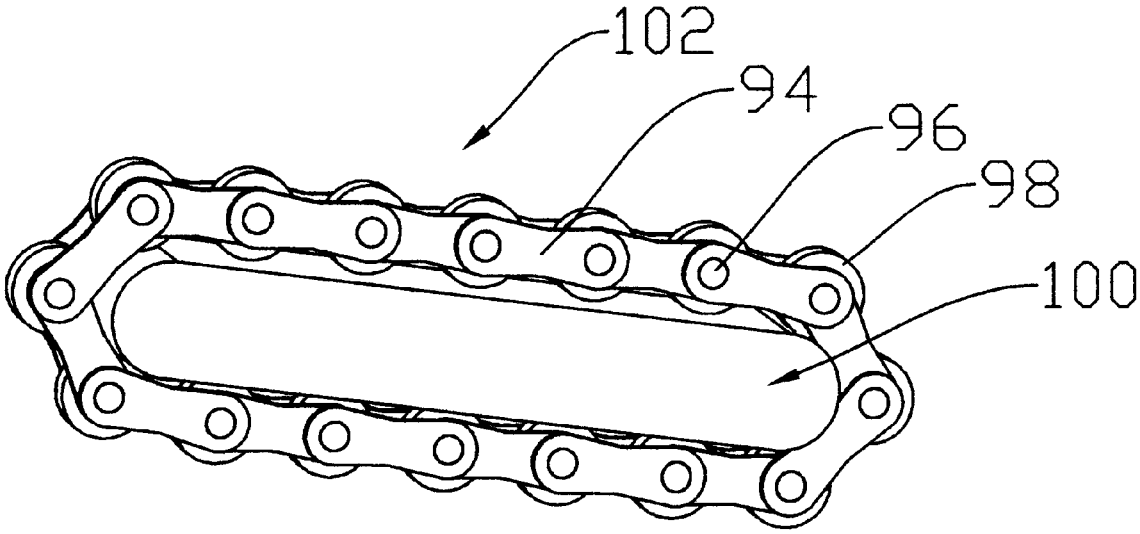
FIG. 7 is a detail view of another alternate embodiment of the invention.

FIG. 7 illustrates a second alternate embodiment of the invention. The alternate track guide apparatus is generally indicated by the numeral 102. The link 94 and pins 96 are similar to the link and pin shown in FIGS. 5 and 6. Roller 98 contacts the rail 100 and the leg, not shown. Roller 98 may be incorporated with the pin 96 as one component. For clarity, the rail flanges that attach the rail to the tower are not shown.

Because many varying and differing embodiments may be made within the scope of the inventive concept herein taught and because many modifications may be made in the embodiment herein detailed in accordance with the descriptive requirement of the law, it is to be understood that the details herein re to be interpreted as illustrative and not in a limiting sense.

What is claimed as invention is:

1. An apparatus for guiding the legs of a lift boat during relative vertical movement between the legs and the lift boat, comprising:

a. leg tower attached to the lift boat, said leg tower movably receiving a leg of the lift boat therethrough and having an elongated opening along the length of said leg tower; and b. a track guide mounted on the leg tower such that said track guide contacts the leg of the lift boat through the elongated opening in said leg tower and maintains said track guide in contact with the leg of the lift boat in a pre-load condition such that said track guide confines the leg to a near perpendicular orientation relative to the lift boat and prevents out of alignment movement of the leg relative to the lift boat, said track guide comprising:

i. a rail structure; and ii. a continuous track mounted on said rail structure for movement thereon.

* * * * *